US008205658B1

(12) United States Patent
Lin

(10) Patent No.: US 8,205,658 B1
(45) Date of Patent: Jun. 26, 2012

(54) OPERATING DEVICE FOR ROTATING A WINDING ROLLER OF A WINDOW BLIND

(76) Inventor: Shih-Ming Lin, Chiayi Hsien (TW)

( * ) Notice: Subject to any disclaimer, the term of this patent is extended or adjusted under 35 U.S.C. 154(b) by 0 days.

(21) Appl. No.: 13/036,066

(22) Filed: Feb. 28, 2011

(51) Int. Cl.
*E06B 9/30* (2006.01)

(52) U.S. Cl. ..... 160/320; 160/168.1 R; 160/173 R; 160/178.1 R; 74/127

(58) Field of Classification Search ..... 160/309, 160/320, 314, 177 R, 177 V, 176.1 R, 176.1 V, 160/168.1 R, 168.1 V, 178.1 R, 178.1 V, 173 R, 160/173 V, 107; 74/127, 499, 509; 81/DIG. 2
See application file for complete search history.

(56) References Cited

U.S. PATENT DOCUMENTS

| | | | | | |
|---|---|---|---|---|---|
| 157,087 | A | * | 11/1874 | Allard | 74/127 |
| 301,915 | A | * | 7/1884 | Olson | 74/127 |
| 354,359 | A | * | 12/1886 | Spencer | 74/127 |
| 407,842 | A | * | 7/1889 | Schuermann | 74/127 |
| 470,055 | A | * | 3/1892 | Jones | 74/127 |
| 528,731 | A | * | 11/1894 | Morrison | 74/127 |
| 568,460 | A | * | 9/1896 | Schay | 74/127 |
| 873,296 | A | * | 12/1907 | Chappelle | 74/127 |
| 1,516,443 | A | * | 11/1924 | Leopold | 74/127 |
| 1,630,976 | A | * | 5/1927 | Smith | 74/127 |
| 1,821,841 | A | * | 9/1931 | Leopold | 74/127 |
| 1,838,957 | A | * | 12/1931 | Orawiec | 74/127 |
| 2,301,413 | A | * | 11/1942 | Kilcup | 74/57 |
| 2,455,434 | A | * | 12/1948 | Mikelson | 74/127 |
| 3,656,358 | A | * | 4/1972 | Kopp | 74/424.96 |
| 4,759,398 | A | * | 7/1988 | Renee | 160/178.1 R |
| 5,472,035 | A | * | 12/1995 | Biba et al. | 160/168.1 R |
| 5,787,953 | A | * | 8/1998 | Jacobson | 160/168.1 R |
| 5,899,640 | A | * | 5/1999 | Yeh | 405/259.1 |
| 6,044,890 | A | * | 4/2000 | Renee | 160/177 R |
| 6,115,884 | A | * | 9/2000 | DeJong et al. | 16/197 |
| 6,298,897 | B1 | * | 10/2001 | Metcalf et al. | 160/177 R |
| 6,378,646 | B1 | * | 4/2002 | Bugosh | 180/444 |
| 7,779,886 | B2 | * | 8/2010 | Ganzi | 160/168.1 R |
| 7,946,198 | B2 | * | 5/2011 | Gui et al. | 81/58.1 |
| 2009/0126521 | A1 | * | 5/2009 | Schroeder | 74/127 |
| 2009/0288507 | A1 | * | 11/2009 | Toti et al. | 74/89.23 |
| 2011/0186240 | A1 | | 8/2011 | Lin | |

FOREIGN PATENT DOCUMENTS

EP 2369123 A1 9/2011

* cited by examiner

*Primary Examiner* — Katherine W Mitchell
*Assistant Examiner* — Johnnie A Shablack

(57) ABSTRACT

An operating device for rotating a winding roller of a window blind, includes an upright rotating shaft rotatable to cause rotation of the winding roller and having thread segments, a sleeve shell surrounding the rotating shaft, upper and lower coupling members anchored on the sleeve shell and each having grip ends and cammed surfaces confronting the thread segments and the sleeve shell, and an actuating member having a camming surfaces disposed to be moved upward or downward to make an upper or lower friction engagements between the upper coupling member and rotating shaft, and between the lower coupling member and the rotating shaft for rotating the rotating shaft.

9 Claims, 7 Drawing Sheets

OPERATING DEVICE FOR ROTATING A WINDING ROLLER OF A WINDOW BLIND

BACKGROUND OF THE INVENTION

1. Field of the Invention

This invention relates to a window blind, more particularly to an operating device for rotating a winding shaft of a window blind to wind up or winding down a curtain cloth.

2. Description of the Related Art

A conventional window blind generally includes a winding roller, a curtain cloth extending downwardly from the roller, and a ring chain (or cord) disposed on an end portion of the roller and extending downwardly. A user can pull the ring chain to rotate the winding roller such that the curtain cloth can be wound upwardly or downwardly. However, it is of no rare occurrence that the ring chain might wrap around a child's neck if the child sticks his/her head in the loop formed by the ring chain, thereby causing strangling incident. Another window blind such as those disclosed in EP Application No. 10157918.3 and U.S. patent application Ser. No. 12/696,173, is provided with an operating rod to replace the ring chain. The operating rod extends vertically and has an upper end coupled with a winding roller by a rotation transmitting mechanism such that vertical rotation of the operating rod results in horizontal rotation of the winding roller, and a lower end coupled with a hinged handle that is manipulated to rotate the operating rod. Since the hinged handle is disposed remote from the winding roller, a force applied to the handle is hard to be transmitted to the rotation transmitting mechanism, thereby rendering the operation laborious and inefficient.

SUMMARY OF THE INVENTION

An object of the present invention is to provide an operating device for rotating a winding roller of a window blind which is operable easily and smoothly, and which is suitable for winding a relatively long curtain cloth.

According to this invention, the operating device includes a rotating shaft which is adapted to be coupled with a winding roller of a window blind such that a counterclockwise or clockwise rotation of the rotating shaft about an upright axis results in horizontal rotation of the winding roller for a corresponding winding-up or winding-down of a curtain cloth. The rotating shaft has a shaft body having upper and lower thread segments. A sleeve shell is disposed to surround and permit the shaft body to be rotatable relative thereto so as to cooperatively define an accommodation space, and extends in a direction of the upright axis to terminate at upper and lower peripheral ends. Upper and lower coupling members are disposed in the accommodation space. Each of the upper and lower coupling members includes an anchored end anchored on the sleeve shell, and at least one finger portion which extends from the anchored end to terminate at a grip end, and which has a cammed surface that radially confronts the sleeve shell. The grip end has an engageable region which radially confronts a corresponding one of the upper and lower thread segments such that an upper friction engagement between the engageable region of the upper coupling member and the upper thread segment permits the counterclockwise rotation of the rotary shaft when a manual force is applied to move the sleeve shell upward, and such that a lower friction engagement between the engageable region of the lower coupling member and the lower thread segment permits the clockwise rotation of the rotary shaft when a manual force is applied to move the sleeve shell downward. An actuating member is disposed in the accommodation space, is movable relative to the upper and lower coupling members in the direction of upright axis, and has upper and lower inner tubular wail portions, each of which has a caroming surface that is configured to mate with the cammed surface of a respective one of the upper and lower coupling members such that, when the actuating member is moved upward from a non-actuating position to an upper actuating position, the engageable region of the upper coupling member is pressed to make the upper friction engagement with the upper thread segment as a result of an upper cam action between the upper camming and cammed surfaces, and such that, when the actuating member is moved downward from the non-actuating position to a lower actuating position, the engageable region of the lower coupling member is pressed to make the lower friction engagement with the lower thread segment as a result of a lower cam action between the lower caroming and rammed surfaces.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
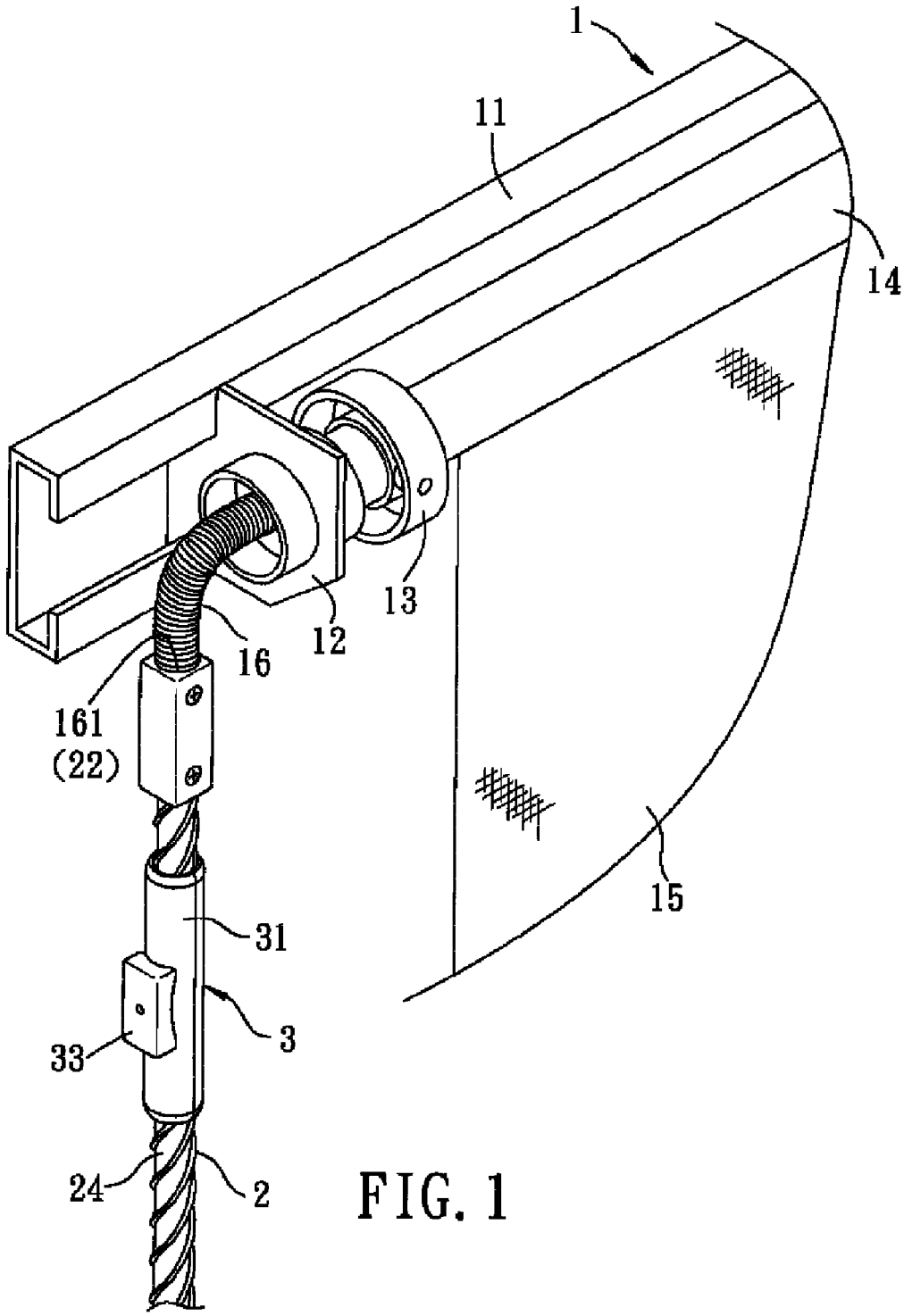
FIG. 1 is a fragmentary perspective view of the preferred embodiment of an operating device incorporated in a window blind according to this invention.
Figure 2:
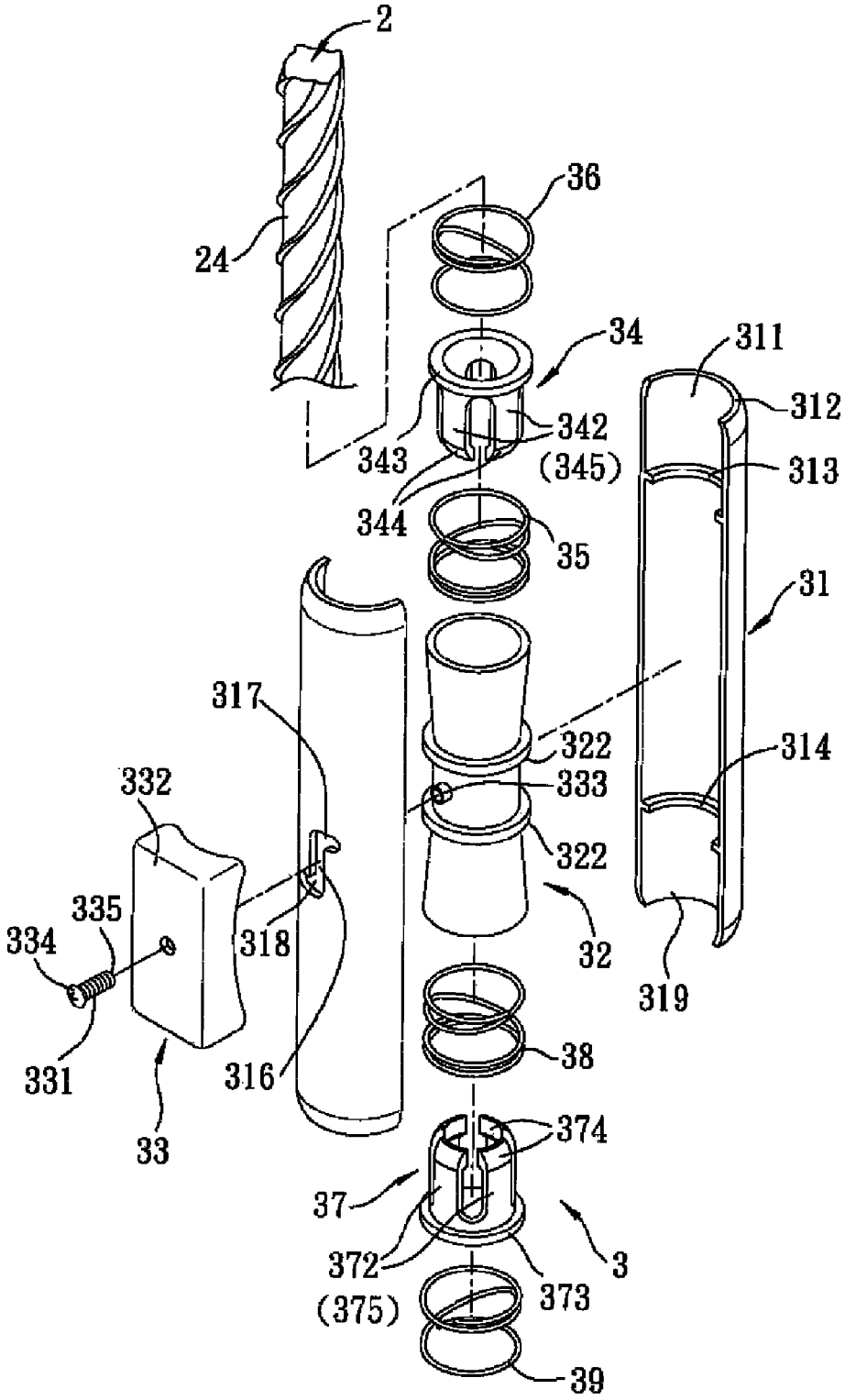
FIG. 2 is a fragmentary exploded perspective view of the preferred embodiment.
Figure 3:
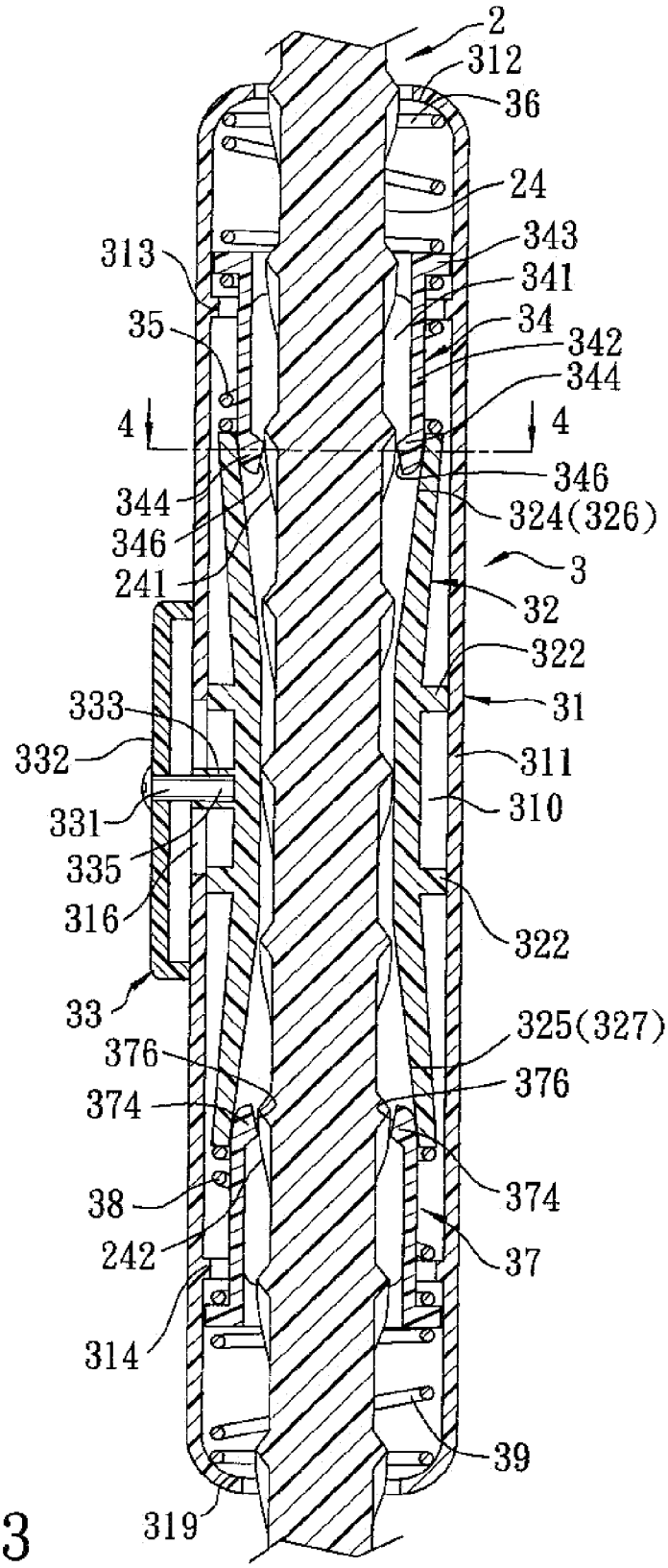
FIG. 3 is a fragmentary sectional view of the preferred embodiment when an actuating member is in a non-actuating position.

Referring to FIGS. 1 to 3, the preferred embodiment of an operating device according to the present invention is shown to be mounted on a window blind 1 for rotating a winding roller 14 of the window blind 1. The window blind 1 includes a horizontal extending headrail 11, two mounts 12 (only one is shown in FIG. 1) spacedly disposed on the headrail 11, two rotary sleeves 13 (only one is shown in FIG. 1) rotatably mounted between the mounts 12, the winding roller 14 operatively coupled with the rotary sleeves 13 to be rotatable relative to the headrail 11 about a horizontal axis for winding up or winding down a curtain cloth 15, and a coupling mechanism 16 operatively coupled with one of the rotary sleeves 13, and having a connecting end 161. The operating device of this invention is connected to the connecting end 161, and is shown to comprise a rotating shaft 2 and a driving mechanism 3 mounted on the rotating shaft 2.

The rotating shaft 2 has an upper shaft end 22 which is adapted to be connected to the connecting end 161 of the coupling mechanism 16 such that a counterclockwise or clockwise rotation of the rotating shaft 2 about an upright axis transverse to a direction of the horizontal axis results in horizontal rotation of the winding roller 14 for a corresponding winding-up or winding-down of the curtain cloth, a shaft body 24 extending from the upper shaft end 22 along the upright axis to terminate at a lower shaft end. The shaft body 24 has upper and lower thread segments 241, 242 which are disposed on an outer shaft surface thereof and which are proximate to the upper shaft end 22 and the lower shaft end, respectively. In this embodiment, the shaft body 24 has external threads on its entire cuter surface.

The driving mechanism 3 includes a sleeve shell 31, upper and lower coupling members 34, 37, an actuating member 32, a control member 33, and first, second, third, and fourth biasing springs 35, 38, 36, 39.

The sleeve shell 31 includes two shell halves matingly connected to each other to have a barrel wall 311 which surrounds and permits the shaft body 24 to be rotatable relative thereto so as to cooperatively define an accommodation space 310, and which has an inner shell wall surface that confronts the shaft body 24, and that extends in a direction of the upright axis to terminate at upper and lower peripheral ends 312, 319. Upper and lower abutment ledges 313, 314 are disposed on the inner shell wail surface. Further, the shell wall 311 has an elongated slot 316 extending in the direction of upright axis to terminate at upper and lower retaining ends 317, 318 that oppositely extend circumferentially.

The upper and lower coupling members 34, 37 disposed in the accommodation space 310 and proximate to the upper and lower peripheral ends 312, 319, respectively. Each of the upper and lower coupling members 34, 37 includes an anchored end 343, 373 which is in frictional engagement with and slidable relative to the inner shell wall surface of the sleeve shell 31, and a plurality of finger portions 342, 372 which extend from the anchored end 343, 373 away from a respective one of the upper and lower peripheral ends 312, 319 to terminate at grip ends 344, 374, which are angularly displaced from one another about the upright axis, and which cooperatively have a cammed surface 345, 375 that radially confronts the sleeve shell 31. Each of the grip ends 344, 375 has an engageable region 346, 376 which radially confronts a corresponding one of the upper and lower thread segments 241, 242. Thus, an upper friction engagement between the engageable regions 346 of the upper coupling member 34 and the upper thread segment 241 permits the counterclockwise rotation of the rotary shaft 2 when a manual force is applied to move the sleeve shell 31 upward. A lower friction engagement between the engageable regions 376 of the lower coupling member 37 and the lower thread segment 242 permits the clockwise rotation of the rotary shaft 2 when a manual force is applied to move the sleeve shell 31 downward.

The actuating member 32 is disposed in the accommodation space 310 and has two sliding flange portions 322 which are slidable along the inner shell wall surface of the sleeve shell 31 to be movable relative to the upper and lower coupling members 34, 37 in the direction of upright axis. The actuating member 32 has upper and lower inner tubular wall portions 324, 325 respectively extending from the sliding flange portions 322 to terminate at upper and lower tubular ends. Each of the upper and lower inner tubular wall portions 324, 325 has a camming surface 326, 327 that is configured to mate with the cammed surfaces 345, 375 of a respective one of the upper and lower coupling members 34, 37. In this embodiment, the camming surfaces 326, 327 are configured to be conical that is diverged to the respective one of the upper and lower tubular ends. Therefore, when the actuating member 32 is moved upward from a non-actuating position (FIG. 3) to an upper actuating position (FIG. 5), the engageable regions 346 of the upper coupling member 34 are pressed to make the upper friction engagement with the upper thread segment 241 as a result of an upper cam action between the upper camming and cammed surfaces 326, 345. When the actuating member 32 is moved downward from the non-actuating position to a lower actuating position (FIG. 7), the engageable regions 376 of the lower coupling member 37 are pressed to make the lower friction engagement with the lower thread segment 242 as a result of a lower cam action between the lower camming and cammed surfaces 327, 375.

The control member 33 has a nut 333, a bolt 331, and a knob 332. The nut 333 is disposed between the upper and lower inner tubular wall portions 324, 325, and extends radially from the actuating member 32 to be slidable in the elongated groove 316 so as to serve as a guided portion 333. The nut 333 is further configured to be angularly displaceable to an upper locked position, where the nut 333 is retained in the upper retaining end 317 to hold the actuating member 32 at the upper actuating position, and to a lower lacked position, where the nut 333 is retained in the lower retaining end 318 to hold the actuating member 32 at the lower actuating position. The bolt 331 has a first end 335 which is threadedly engaged in the nut 333 to serve as an actuating end 335, and a second end 334 radially opposite to the first end 335. The knob 332 is connected to the second end 334 and is configured to cover the elongated slot 316 and to be disposed externally of the sleeve shell 31 to be manually operable.

The first biasing spring 35 is disposed between the anchored end 343 of the upper coupling member 34 and the upper tubular end of the actuating member 32 while the second biasing spring 38 is disposed the anchored end 373 of the lower coupling member 37 and the lower tubular end of the actuating member 32 so as to brace the actuating member 32 in the direction of upright axis by virtue of downward and upward biasing forces exerted upon upper and lower tubular ends of the actuating member 32, respectively.

The third biasing spring 36 is disposed between the upper peripheral end 312 and the anchored end 343 of the upper coupling member 34 to bias the anchored end 343 toward the upper tubular end while counteracting the biasing action of the first biasing spring 35. The fourth biasing spring 39 is disposed between the lower peripheral end 319 and the anchored end 373 of the lower coupling member 37 to bias the anchored end 373 toward the lower tubular end while counteracting the biasing action of the second biasing spring 38.

Figure 4:
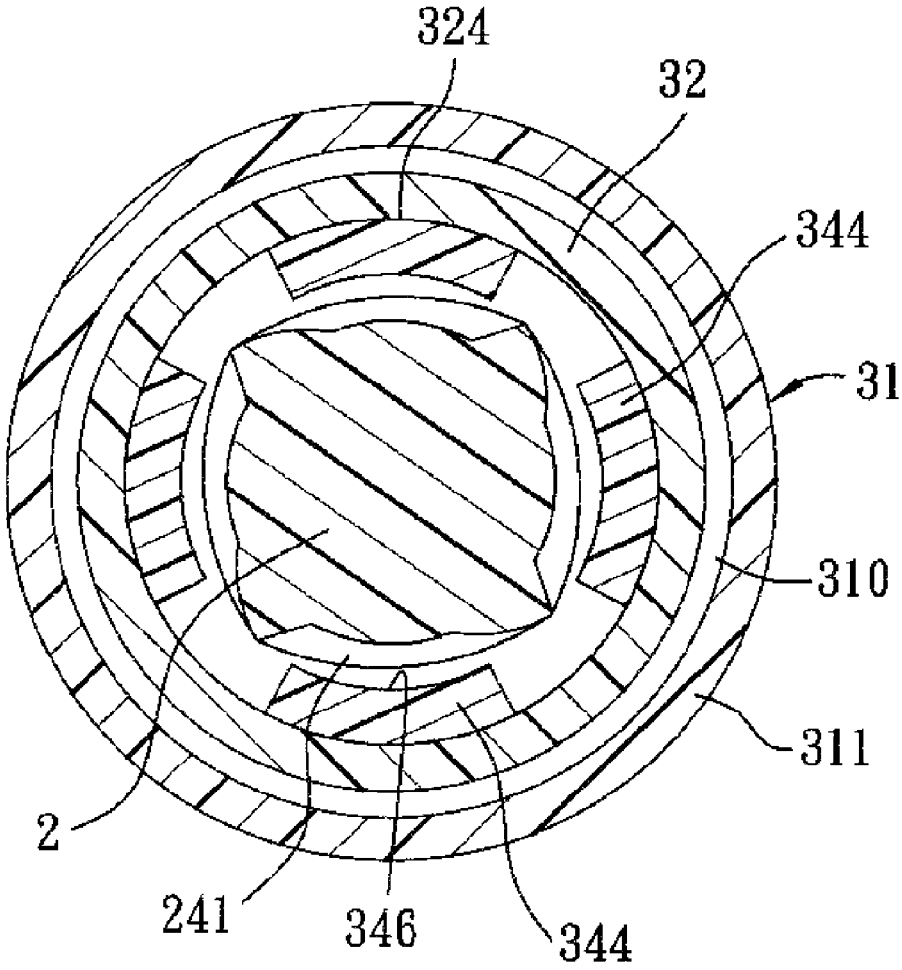
FIG. 4 is a sectional view taken along lines 4-4 of FIG. 3.

Referring to FIGS. 1, 3 and 4, when the actuating member 32 is in the non-actuating position, the grip ends 344, 374 of the upper and lower coupling members 34, 37 are loosely engaged with the upper and lower tubular ends of the actuating member 32 by the biasing action of the first and second biasing springs 35, 38 so that the engageable regions 346, 376 are disengaged from the upper and lower thread segments 241, 242.

Figure 5:
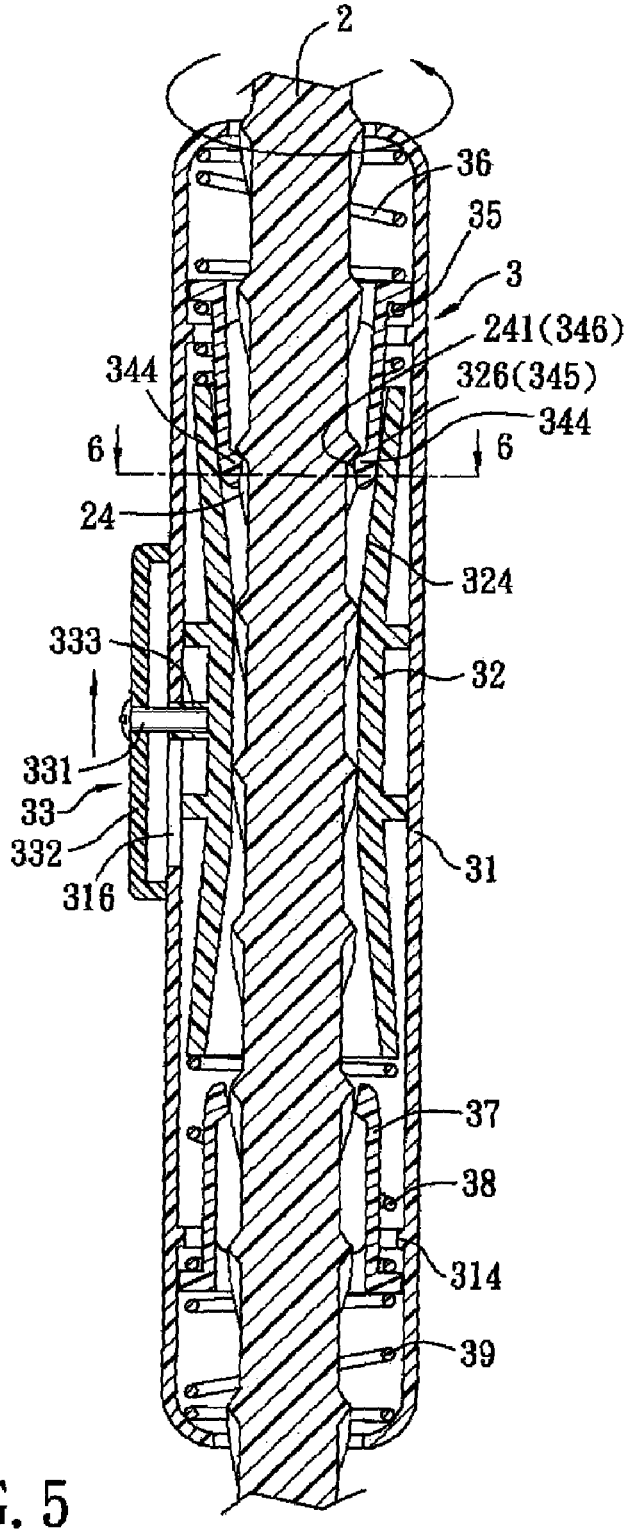
FIG. 5 is a fragmentary sectional view of the preferred embodiment when the actuating member is in an upper actuating position.
Figure 6:
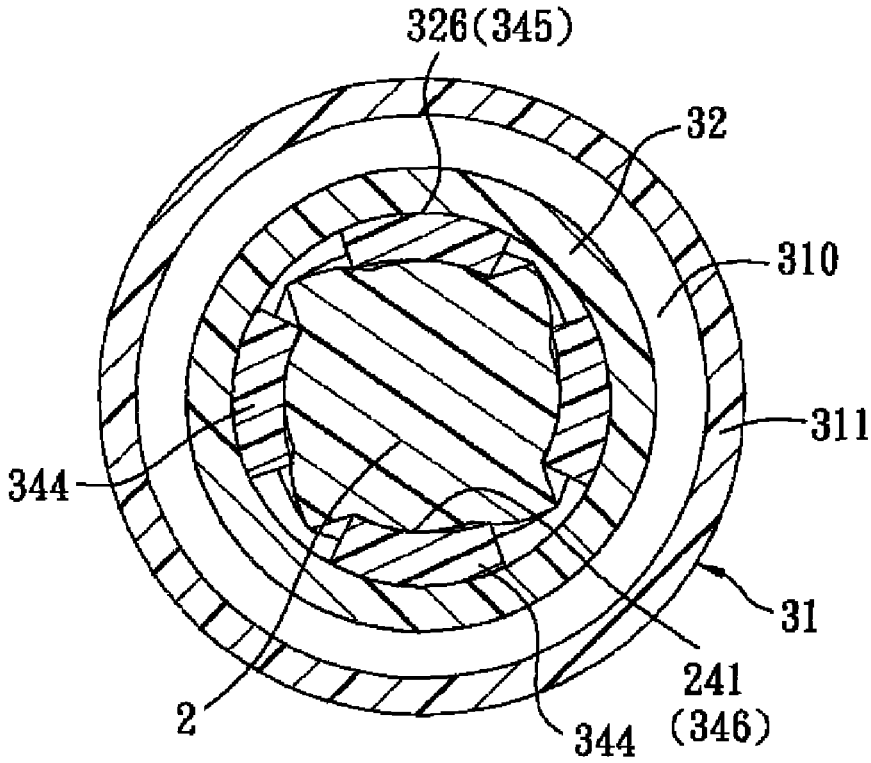
FIG. 6 is a sectional view taken along lines 6-6 of FIG. 5.

Referring to FIGS. 1, 2, 5 and 6, when it is desired to counterclockwise rotate the rotating shaft 2, the user grips the driving mechanism 3 and pushes the control member 33 upward and angularly to permit the nut 333 to be retained in the upper retaining end 317 so as to hold the actuating member 32 at the upper actuating position. At this stage, by an upper cam action between the upper camming and caromed surfaces 326, 345, the engageable regions 346 of the upper coupling member 34 are frictionally engaged with the upper thread segment 241, and the grip ends 344 are vested with a biasing force that urges the corresponding engageable regions 344 to move away from the upper thread segment 241. Subsequently, the user pushes the driving mechanism 3 upwardly to permit counterclockwise rotation of the rotating shaft 2 to thereby rotate the winding roller 14 for winding up the curtain cloth 15. It is noted that when the actuating member 32 is in the upper actuating position as shown in FIG. 5, the lower coupling member 37 is disengaged from the actuating member 32, and may be movable upward by the biasing action of the fourth biasing spring 39. By virtue of the lower abutment ledge 314, an excess upward movement of the lower coupling member 37 can be prevented.

After the driving mechanism 3 is moved to reach a predetermined height position, the user can push the control member 33 away from the upper locked position to permit the actuating member 32 back to the non-actuating position (FIG. 3). The user pulls the driving mechanism 3 downward to a relatively low position, and pushes the control member 33 again to the upper locked position for upwardly moving the driving mechanism 3 to counterclockwise rotate the rotating shaft 2.

Specifically, during winding of the curtain cloth 15, the driving mechanism 3 is reciprocate upward and downward along the rotating shaft 2 to continuously rotate the rotating shaft 2 in the same direction. Such operating device is conveniently and easily operated, particularly for winding a quite long curtain cloth 15 without the need to elongate the length of the rotating shaft 2.

Figure 7:
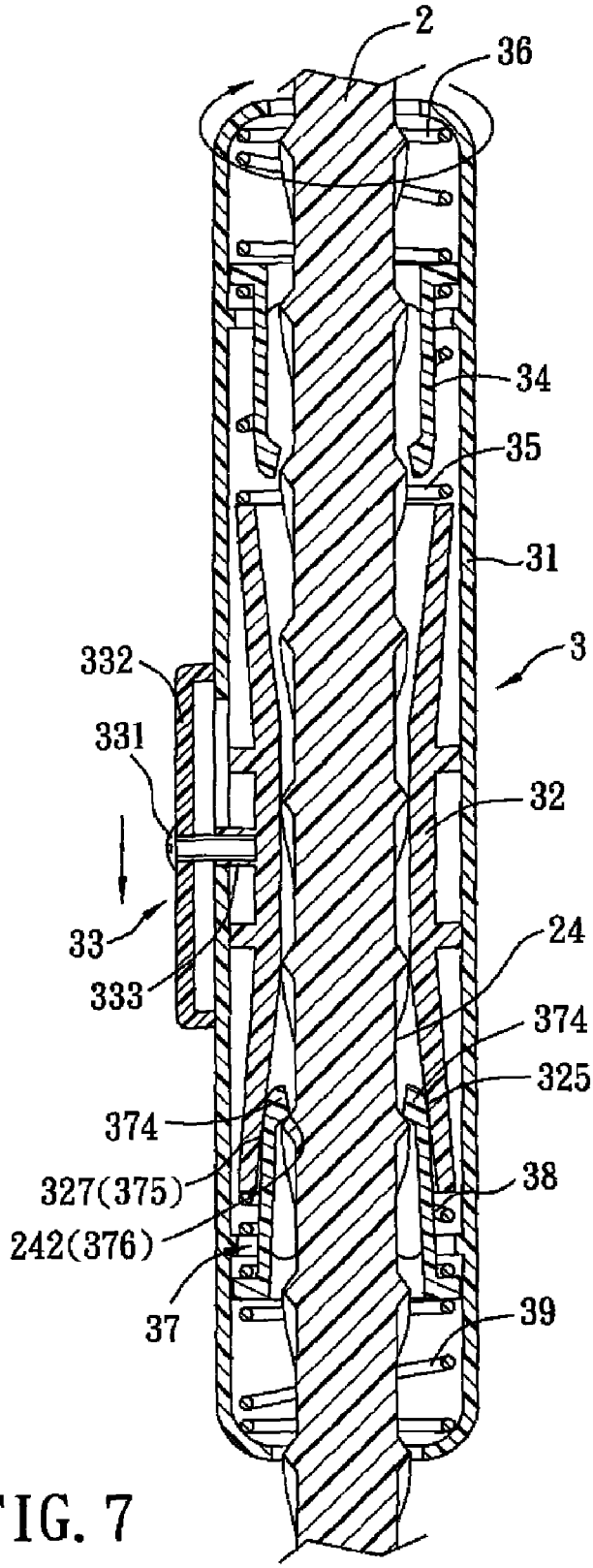
FIG. 7 is a fragmentary sectional view of the preferred embodiment when the actuating member is in a lower actuating position.

Referring to FIGS. 1, 2 and 7, similarly, when it is desired to wind down the curtain cloth 15, the actuating member 32 is moved downward and angularly displaced to permit the nut 333 to be retained in the lower retaining end 318 to hold the actuating member 32 at the lower actuating position. Subsequently, the driving mechanism 3 is pushed downward to clockwise rotate the rotating shaft 2.

As illustrated, the operating device according to this invention is operable smoothly and conveniently, particularly being used for winding a relatively long curtain cloth.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. An operating device for rotating a winding roller of a window blind, the winding roller being rotatable relative to a headrail about a horizontal axis for winding up or winding down a curtain cloth, said operating device comprising:

a rotating shaft having an upper shaft end which is adapted to be coupled with the winding roller such that a counterclockwise or clockwise rotation of said rotating shaft about an upright axis transverse to a direction of the horizontal axis results in horizontal rotation of the winding roller for a corresponding winding-up or winding-down of the curtain cloth, a shaft body extending from said upper shaft end along the upright axis to terminate at a lower shaft end, said shaft body having upper and lower thread segments which are disposed on an outer shaft surface thereof and which are proximate to said upper and lower shaft ends, respectively;

a sleeve shell which is disposed to surround and permit said shaft body to be rotatable relative thereto so as to cooperatively define an accommodation space, and which extends in a direction of the upright axis to terminate at upper and lower peripheral ends;

upper and lower coupling members disposed in said accommodation space and proximate to said upper and lower peripheral ends, respectively, each of said upper and lower coupling members including an anchored end which is anchored on said sleeve shell and proximate to a respective one of said upper and lower peripheral ends, and at least one finger portion which extends from said anchored end away from the respective one of said upper and lower peripheral ends to terminate at a grip end, and which has a cammed surface that radially confronts said sleeve shell, said grip end having an engageable region which radially confronts a corresponding one of said upper and lower thread segments such that an upper friction engagement between said engageable region of said upper coupling member and said upper thread segment permits the counterclockwise rotation of said rotary shaft when a manual force is applied to move said sleeve shell upward, and such that a lower friction engagement between said engageable region of said lower coupling member and said lower thread segment permits the clockwise rotation of said rotary shaft when a manual force is applied to move said sleeve shell downward; and an actuating member disposed in said accommodation space and movable relative to said upper and lower coupling members in the direction of upright axis, and having upper and lower inner tubular wall portions, each of which has a camming surface that is configured to mate with said cammed surface of a respective one of said upper and lower coupling members such that, when said actuating member is moved upward from a non-actuating position to an upper actuating position, said engageable region of said upper coupling member is pressed to make the upper friction engagement with said upper thread segment as a result of an upper cam action between said upper camming and cammed surfaces, and such that, when said actuating member is moved downward from the non-actuating position to a lower actuating position, said engageable region of said lower coupling member is pressed to make the lower friction engagement with said lower thread segment as a result of a lower cam action between said lower camming and cammed surfaces.

2. The operating device according to claim 1, further comprising:

a control member having an actuating end which is configured to axially move said actuating member among the non-actuating position, the upper actuating position and the lower actuating position, and an operating end which is radially opposite to said actuating end, and which is disposed externally of said sleeve shell to be manually operable.

3. The operating device according to claim 2, wherein said sleeve shell has a shell wall defining said accommodation space, and having an elongated slot extending in the direction of upright axis to terminate at upper and lower retaining ends that extend circumferentially, said control member having a guided portion which is configured to extend through, and be slidable relative to said elongated slot so as to permit said actuating end to move axially, said guided portion being further configured to be angularly displaceable to an upper locked position, where said guided portion is retained in said upper retaining end to hold said actuating member at the upper actuating position, and to a lower locked position, where said guided portion is retained in said lower retaining end to hold said actuating member at the lower actuating position.

4. The operating device according to claim 3, wherein said guided portion is configured to be a nut which is disposed between said upper and lower inner tubular wall portions, and which extends radially from said actuating member and into said elongated groove, said control member including a bolt which has a first end that is threadedly engaged in said nut, and a second end radially opposite to said first end, and a knob which is connected to said second end and which is configured to cover said elongated slot.

5. The operating device according to claim 1, wherein each of said upper and lower coupling members includes a plurality of said finger portions which are angularly displaced from each other about the upright axis, and which are configured such that said grip ends of each of said upper coupling member are vested with a biasing force that urges said corresponding engageable regions to move away from a corresponding one of said upper and lower thread segments.

6. The operating device according to claim 5, further comprising first and second biasing springs disposed to brace said actuating member in the direction of upright axis by virtue of downward and upward biasing forces exerted upon upper and lower tubular ends of said actuating member, respectively.

7. The operating device according to claim 6, wherein said anchored end of each of said upper and lower coupling members is in frictional engagement with and slidable relative to said sleeve shell, said operating device further comprising a third biasing spring disposed to bias said anchored end of said upper coupling member toward said upper tubular end of said actuating member while counteracting the biasing action of said first biasing spring, and a fourth biasing spring disposed to bias said anchored end of said lower coupling member toward said lower tubular end of said actuating member while counteracting the biasing action of said second biasing spring.

8. The operating device according to claim 7, wherein said first and second biasing springs are respectively disposed between said anchored end of said upper coupling member and said upper tubular end, and between said anchored end of said lower coupling member and said lower tubular end, said third and fourth biasing springs being respectively disposed between said upper peripheral end and said anchored end of said upper coupling member, and between said lower peripheral end and said anchored end of said lower coupling member.

9. The operating device according to claim 8, wherein said sleeve shell has an inner shell wall surface which confronts said shaft body, and which is interposed between said upper and lower peripheral ends, and upper and lower abutment ledges which are disposed on said inner shell wall surface and respectively between said anchored end of said upper coupling member and said upper tubular end, and between said anchored end of said lower coupling member and said lower tubular end, so as to restrict movement of said upper and lower coupling members in the direction of upright axis.

* * * * *